US010590897B2

(12) United States Patent
Kitajima et al.

(10) Patent No.: US 10,590,897 B2
(45) Date of Patent: Mar. 17, 2020

(54) HIGH-PRESSURE FUEL SUPPLY PUMP, MANUFACTURING METHOD THEREOF, AND METHOD OF BONDING TWO MEMBERS

(71) Applicant: Hitachi Automotive Systems, Ltd., Hitachinaka-shi, Ibaraki (JP)

(72) Inventors: Daisuke Kitajima, Hitachinaka (JP); Kenichi Gunji, Hitachinaka (JP); Shinichirou Enomoto, Hitachinaka (JP); Masayuki Kobayashi, Hitachinaka (JP); Masamichi Yagai, Hitachinaka (JP); Masahiro Moritaka, Hitachinaka (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/769,238

(22) PCT Filed: Oct. 5, 2016

(86) PCT No.: PCT/JP2016/079568
§ 371 (c)(1),
(2) Date: Apr. 18, 2018

(87) PCT Pub. No.: WO2017/068975
PCT Pub. Date: Apr. 27, 2017

(65) Prior Publication Data

US 2018/0313313 A1 Nov. 1, 2018

(30) Foreign Application Priority Data

Oct. 23, 2015 (JP) ..... 2015-208528

(51) Int. Cl.
*F02M 59/26* (2006.01)
*F04B 1/04* (2006.01)
(Continued)

(52) U.S. Cl.
CPC ..... *F02M 59/26* (2013.01); *F02M 59/442* (2013.01); *F02M 59/485* (2013.01);
(Continued)

(58) Field of Classification Search
CPC .... F02M 59/26; F02M 59/442; F02M 59/485; F02M 2200/16; F02M 2200/8015;
(Continued)

(56) References Cited

U.S. PATENT DOCUMENTS 5,409,641 A 4/1995 Kubo
2004/0164496 A1* 8/2004 Okada ..... F02M 59/442 277/549

(Continued)

FOREIGN PATENT DOCUMENTS

DE 10 2004 063 074 A1 7/2006
JP S53-062022 A 6/1978

(Continued)

OTHER PUBLICATIONS

International Search Report with English translation and Written Opinion issued in corresponding application No. PCT/JP2016/079568 dated Dec. 13, 2016.

(Continued)

*Primary Examiner* — Mahmoud Gimie
(74) *Attorney, Agent, or Firm* — Foley & Lardner LLP

(57) ABSTRACT

Provided is a high-pressure fuel supply pump capable of fixing a cylinder to a pump body with excellent sealability in a simple structure even at a high fuel pressure.

A high-pressure fuel supply pump including a pump body in which a pressurizing chamber is formed, and a cylinder inserted into a hole formed in the pump body and formed in a cylindrical shape, the high-pressure fuel supply pump including: a protrusion disposed at an end portion of the pump body opposite to the pressurizing chamber, formed (Continued)

from an outer peripheral side to an inner peripheral side with respect to an inner peripheral surface opposite to an outer peripheral surface of the cylinder, and protruding toward the cylinder, wherein the protrusion is formed so as to protrude to a side opposite to the pressurizing chamber with respect to a flat portion of the end portion of the pump body, and the protrusion is formed so as to support the cylinder from a side opposite to the pressurizing chamber.

14 Claims, 13 Drawing Sheets

(51) Int. Cl.

| | |
|---|---|
| ***F02M 59/44*** | (2006.01) |
| ***F04B 1/0448*** | (2020.01) |
| ***F02M 59/48*** | (2006.01) |
| ***F04B 1/0426*** | (2020.01) |
| ***F04B 1/053*** | (2020.01) |
| ***F04B 7/00*** | (2006.01) |
| ***F04B 9/04*** | (2006.01) |
| ***F04B 11/00*** | (2006.01) |
| ***F04B 53/16*** | (2006.01) |

(52) U.S. Cl.
CPC ..... *F04B 1/0426* (2013.01); *F04B 1/0448* (2013.01); *F04B 1/053* (2013.01); *F04B 7/0076* (2013.01); *F04B 9/042* (2013.01); *F04B 11/0016* (2013.01); *F04B 53/16* (2013.01); *F02M 2200/16* (2013.01); *F02M 2200/8015* (2013.01); *F02M 2200/8053* (2013.01)

(58) Field of Classification Search
CPC ..... F02M 2200/8053; F04B 1/0426; F04B 1/0448; F04B 1/053; F04B 7/0076; F04B 9/042; F04B 11/0016; F04B 53/16
USPC ..... 123/495
See application file for complete search history.

(56) References Cited

U.S. PATENT DOCUMENTS

| | | | |
|---|---|---|---|
| 2010/0129014 | A1 | 5/2010 | Bitou et al. |
| 2015/0300338 | A1 | 10/2015 | Aritomi et al. |

FOREIGN PATENT DOCUMENTS

| | | | |
|---|---|---|---|
| JP | 54-127979 | U | 9/1979 |
| JP | 54-140153 | U | 9/1979 |
| JP | S62-025018 | U1 | 2/1987 |
| JP | H06-020304 | A | 1/1994 |
| JP | H06-042519 | A | 2/1994 |
| JP | 2002-213470 | A | 7/2002 |
| JP | 2002-310300 | A | 10/2002 |
| JP | 2002-337683 | A | 11/2002 |
| JP | 2008-019985 | A | 1/2008 |
| JP | 2008-175384 | A | 7/2008 |
| JP | 2009-085232 | A | 4/2009 |
| JP | 2009-185613 | A | 8/2009 |
| JP | 5178676 | B2 | 4/2013 |
| JP | 2014-088838 | A | 5/2014 |

OTHER PUBLICATIONS

Office Action Issued in corresponding Japanese Patent Application No. 2019-050821 dated Jan. 21, 2020, with English language machine translation.

* cited by examiner

HIGH-PRESSURE FUEL SUPPLY PUMP, MANUFACTURING METHOD THEREOF, AND METHOD OF BONDING TWO MEMBERS

TECHNICAL FIELD

The present invention relates to a high-pressure fuel supply pump, a manufacturing method thereof, and a method of bonding two members.

BACKGROUND ART

In internal combustion engines such as automobiles, high-pressure fuel supply pumps for increasing the pressure of fuel are widely used in a direct injection type of fuel into a combustion chamber.

JP 5178676 A of PTL 1 discloses a high-pressure fuel supply pump having a fixing structure in which an outer periphery of a cylinder is held by a cylindrical fitting portion of a cylinder holder and a screw threaded on the outer periphery of the cylinder holder is screwed into a screw threaded on a pump body such that one cylinder end surface is brought into close contact with the pump body and the other cylinder end surface is brought into close contact with the cylinder holder.

PTL 2 discloses a hydraulic pump of a hydraulic unit for a brake device, in which a liner is fitted into a cylinder hole formed in a housing, a liner is brought into metallic contact with the housing by a caulking load at the time of caulking a periphery of a plug closing an opening of the cylinder hole, and an internal seal is formed between the housing and the liner to seal a suction side and a discharge side of the pump.

CITATION LIST

Patent Literature

PTL 1: JP 5178676 A
PTL 2: 2002-337683 A

SUMMARY OF INVENTION

Technical Problem

Recently, in a direct injection type of directly injecting fuel into a combustion chamber in an internal combustion engine of an automobile, there is a growing need for increasing a pressure of fuel from the viewpoint of compliance with environmental regulations. In addition, in order to increase the pressure of the fuel, high strength materials (high hardness materials) having a high deformation resistance have been applied to materials of components.

In PTL 1, in order to cope with the higher pressure of fuel, it is necessary to increase the tightening axial force of the screw and fix the cylinder to the pump body, resulting in an increase in the screw size, an increase in the size of the pump body, an increase in the manufacturing cost, and an increase in the restrictions on the mounting to the internal combustion engine. Thus, there is a fear that impairs merchantability.

In addition, as a method of sealing the cylinder and the pump body, the cylinder end surface is brought into close contact with the pump body by the axial force of the screw. However, in this method, deformation is impossible until close contact, depending on the surface roughness of the contact surface, and there is a fear that a fine gap may remain. Furthermore, there is a fear that the contact surface causes a partial contact according to geometrical tolerance such as the squareness of components and the rattling of the screw part, thus not maintaining sealability.

On the other hand, as an example of making the fixing of the cylinder compact, there is also a method using caulking coupling. In PTL 2 that is an example of caulking coupling, when the periphery of the plug closing the opening of the cylinder hole provided in the housing is caulked, the material of the housing plastically flows toward the inner diameter side (the center side of the cylinder hole) and in the direction of the step portion of the outer periphery of the plug by locally pressurizing the opening flat portion of the cylinder hole with the stepped annular portion at the tip of the punch.

At this time, since the stress of the caulking load tends to concentrate on the stepped portion of the tip of the punch, and further, the material plastically flows toward the inner diameter side of the plug (the center side of the plug) by the caulking coupling, a bending force caused by the friction of the plastic flow is applied to the pressurizing surface of the punch serving as the contact surface between the punch and the housing, and the punch may be easily broken from the stepped portion. In particular, in a case where a high strength material having a tensile strength of, for example, about 1,000 MPa is used as the material of the housing so as to cope with the high pressure of the fuel, the life of the punch may be remarkably lowered even if the punch made of die steel or the like is used.

In addition, since the housing is pressurized to be shear-processed in the axial direction of the cylinder hole and thus is plastically flowed, the plastic flow of the housing may cause a local slippage from the outer diameter side corner portion of the pressurizing portion of the punch toward the center side, and the caulked portion may lead to cracking by the reduction in elongation due to the high strength of the material. Furthermore, for example, in materials such as aluminum die casting materials which have low strength but low elongation, cracks may easily occur from the local slippage and the caulking portion may be broken.

An object of the present invention is to provide a high-pressure fuel supply pump capable of fixing a cylinder to a pump body with excellent sealability in a simple structure even at high fuel pressure.

Solution to Problem

To achieve the above-described object, in the present invention, "a high-pressure fuel supply pump including a pump body in which a pressurizing chamber is formed, and a cylinder inserted into a hole formed in the pump body and formed in a cylindrical shape, includes: a protrusion disposed at an end portion of the pump body opposite to the pressurizing chamber, formed from an outer peripheral side to an inner peripheral side with respect to an inner peripheral surface opposite to an outer peripheral surface of the cylinder, and protruding toward the cylinder, wherein the protrusion is formed so as to protrude to a side opposite to the pressurizing chamber with respect to a flat portion of the end portion of the pump body, and the protrusion is formed so as to support the cylinder from a side opposite to the pressurizing chamber".

Advantageous Effects of Invention

According to the present invention, a high-pressure fuel supply pump capable of fixing a cylinder to a pump body with excellent sealability in a simple structure even at a high fuel pressure can be provided. Other constitutions, operations, and effects of the present invention will be described in detail in the following embodiments.

DESCRIPTION OF EMBODIMENTS

Hereinafter, embodiments according to the present invention will be described.

Embodiment 1

Figure 1:
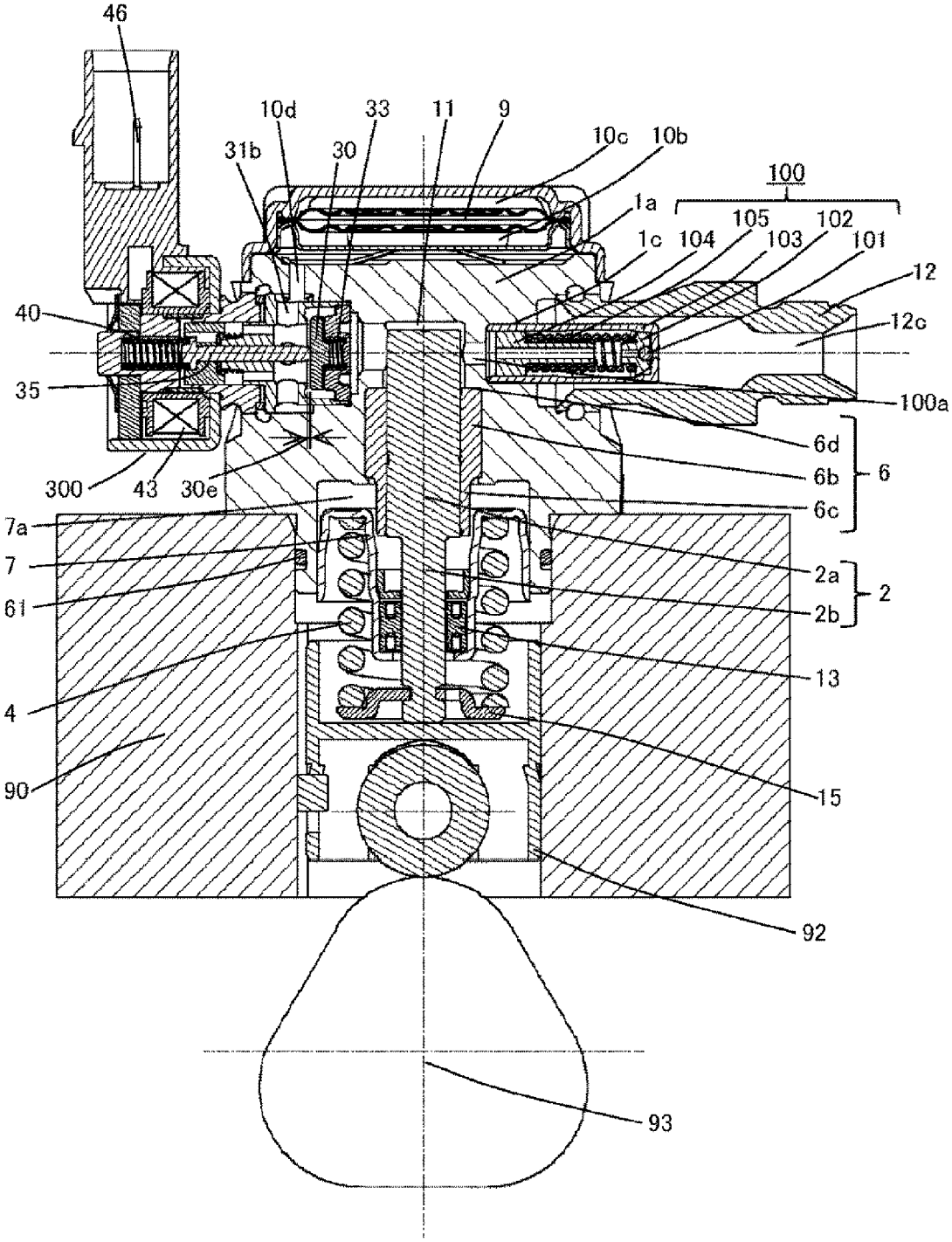
FIG. 1 is an overall longitudinal sectional view of a high-pressure fuel supply pump according to a first embodiment in which the present invention is implemented.
Figure 3:
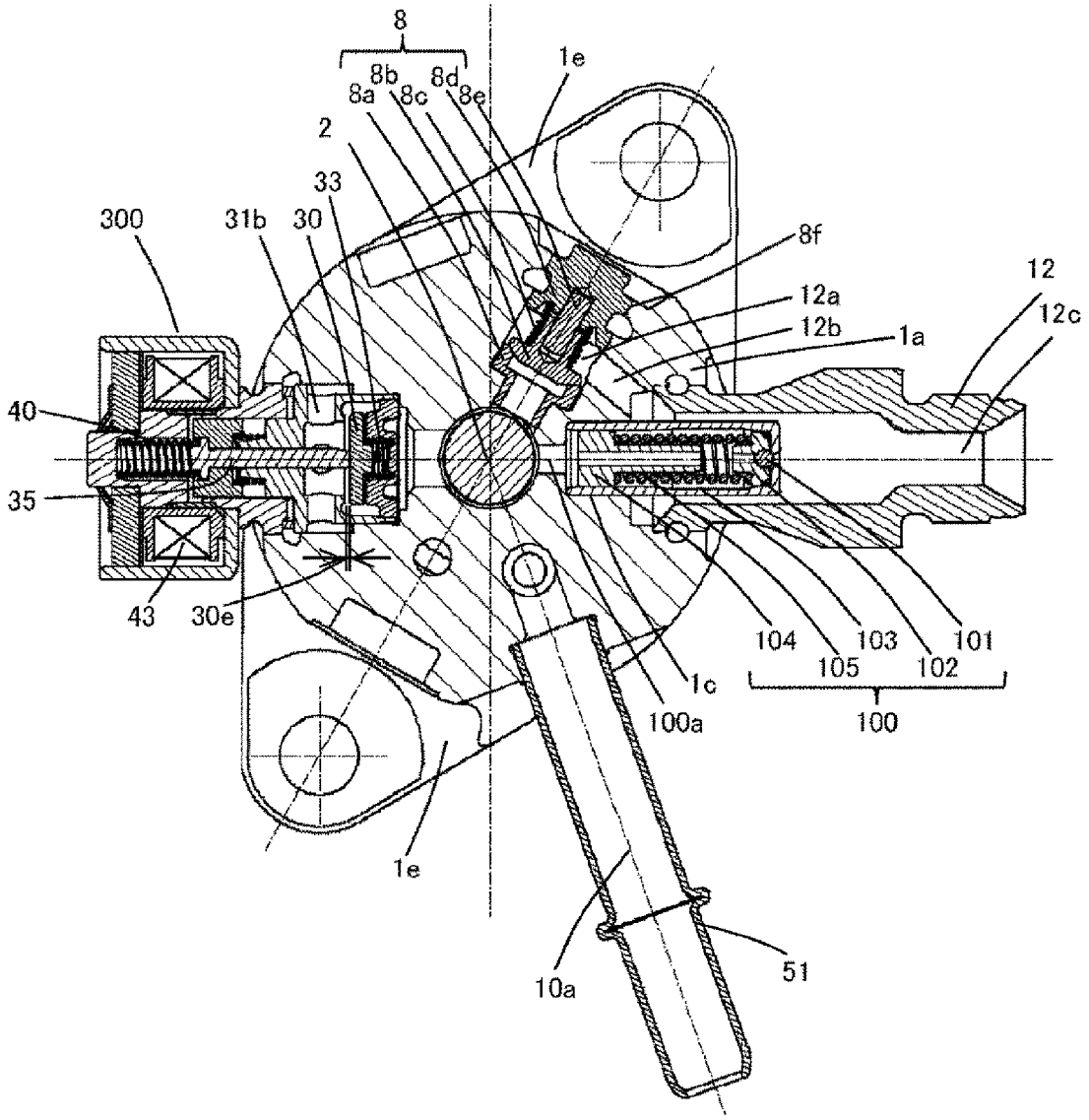
FIG. 3 is an overall cross-sectional view of the high-pressure fuel supply pump according to the first embodiment in which the present invention is implemented and illustrates a sectional view at a center of a suctioned fuel discharge axis.
Figure 4:
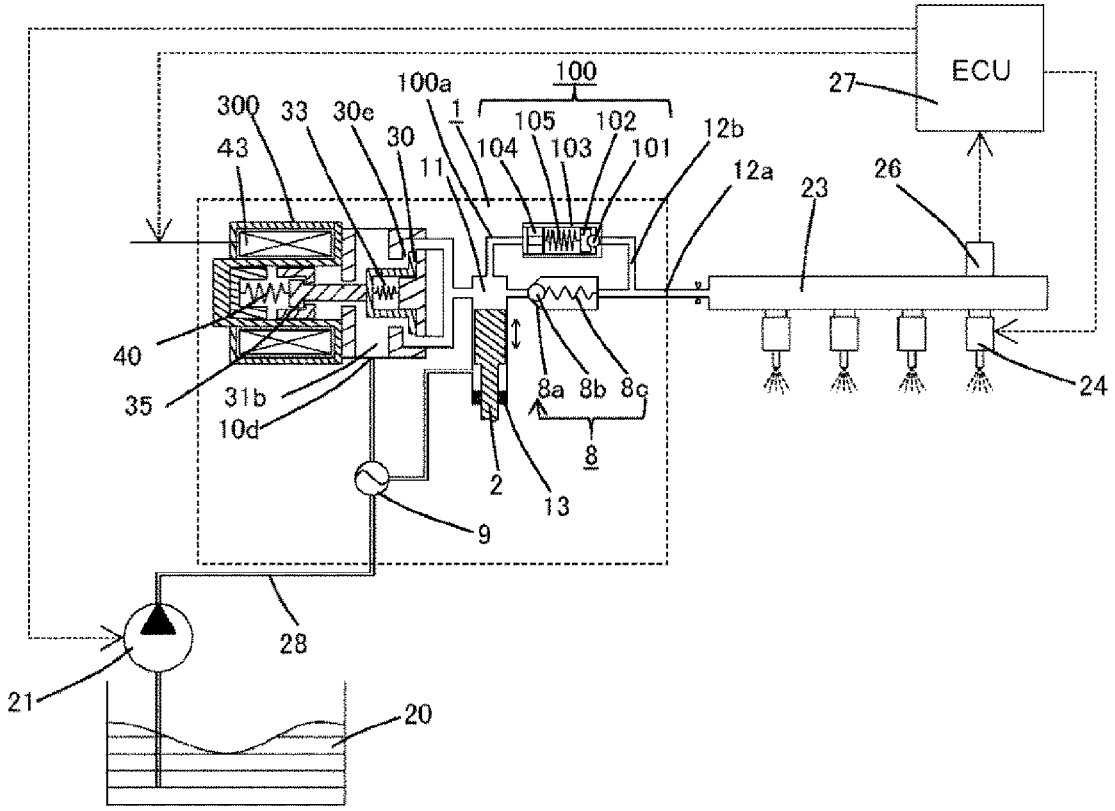
FIG. 4 is an overall configuration diagram of a system.

The structure and operation of a system will be described with reference to FIGS. 1, 3, and 4. FIG. 4 illustrates an overall configuration diagram of a high-pressure fuel supply system to which a high-pressure fuel supply pump (hereinafter referred to as a high-pressure pump) of the present embodiment is applied. In FIG. 4, a portion surrounded by a broken line illustrates a high-pressure pump body, and mechanisms and parts illustrated in this broken line are integrated with the high-pressure pump body 1.

A fuel in a fuel tank 20 is pumped up by a feed pump 21 based on a signal from an engine control unit 27 (hereinafter referred to as an ECU). This fuel is pressurized to an appropriate feed pressure and transferred to a low-pressure fuel suction port 10*a* of the high-pressure fuel supply pump through a suction pipe 28.

The fuel that has passed through a suction joint 51 from the low-pressure fuel suction port 10*a* reaches a suction port 31*b* of an electromagnetic suction valve mechanism 300 constituting a capacity-variable mechanism through a pressure pulsation reduction mechanism 9 and a suction passage 10*d*.

The fuel flowing into the electromagnetic suction valve mechanism 300 passes through a suction valve 30 and flows into a pressurizing chamber 11. Reciprocating power is given to a plunger 2 by a cam mechanism 93 of an engine. Due to the reciprocating motion of the plunger 2, the fuel is sucked from the suction valve 30 in a lowering stroke of the plunger 2, and the fuel is pressurized in a lifting stroke. The fuel is pressure-fed through a discharge valve mechanism 8 to a common rail 23 on which a pressure sensor 26 is mounted. An injector 24 injects the fuel to the engine based on a signal from the ECU 27.

The high-pressure fuel supply pump discharges a fuel flow rate of a desired supply fuel by a signal from the ECU 27 to the electromagnetic suction valve mechanism 300.

Thus, a necessary amount of the fuel guided to the suction joint 51 is pressurized to a high pressure by the reciprocating motion of the plunger 2 in the pressurizing chamber 11 of the pump body 1 and is pressure-fed from a fuel discharge port 12*c* to the common rail 23.

An injector 24 for direct injection (so-called direct injection injector) and the pressure sensor 26 are mounted on the common rail 23. The direct injection injector 24 is mounted according to the number of cylinders of an internal combustion engine, and is opened and closed according to a control signal of the ECU 27 to inject the fuel into the cylinder.

In a case where abnormally high pressure is generated in the common rail 23 or the like by failure of the direct injection injector 24 or the like, when a pressure difference between the fuel discharge port 12*c* and the pressurizing chamber 11 is equal to or higher than a valve opening pressure of a relief valve mechanism 100, a relief valve 101 is opened, and the fuel that has become abnormally high pressure passes through the inside of the relief valve mechanism and is returned from a relief passage 100*a* to the pressurizing chamber 11, such that the piping of the high pressure part such as the common rail 23 is protected.

The present embodiment is the high-pressure fuel supply pump applied to a so-called direct injection engine system in which the injector 24 directly injects the fuel into the cylinder of the engine.

Figure 2:
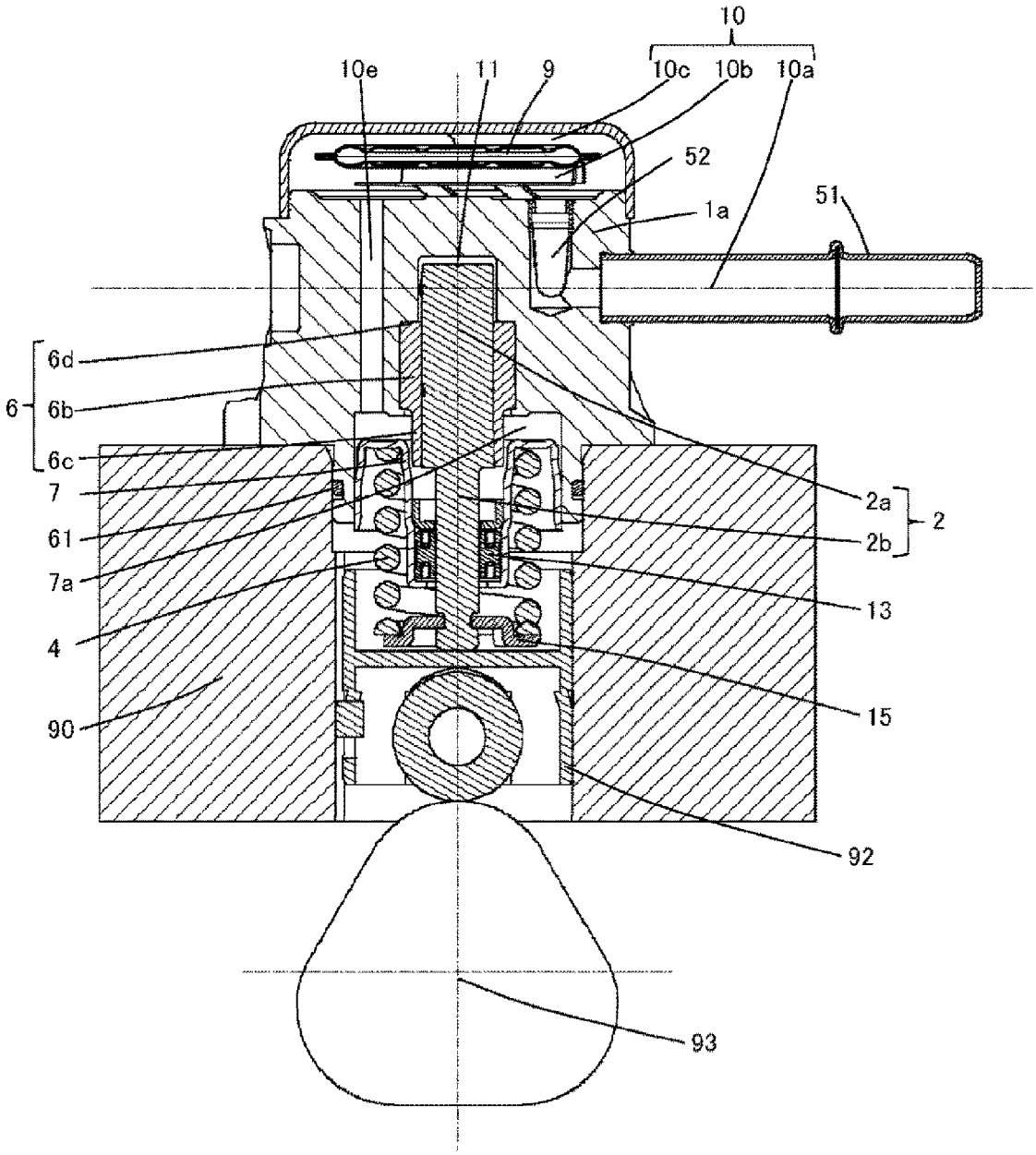
FIG. 2 is an overall longitudinal sectional view of another angle of the high-pressure fuel supply pump of the first embodiment in which the present invention is implemented and illustrates a sectional view at a center of a suction joint axis.

The structure and function of the pump will be described based on FIGS. 1 to 3. FIG. 1 is an overall longitudinal sectional view of the high-pressure fuel supply pump of the present embodiment, and FIG. 2 is an overall longitudinal sectional view of another angle of the high-pressure fuel supply pump of the present embodiment and illustrates a sectional view at a center of a suction joint axis. In addition, FIG. 3 is an overall cross-sectional view of the high-pressure fuel supply pump of the present embodiment and illustrates a sectional view at a center of a suctioned fuel discharge axis.

<Structure and Function>

The high-pressure fuel supply pump of the present embodiment is brought into close contact with a high-pressure fuel supply pump mounting portion 90 of the internal combustion engine by using a mounting flange 1*e* provided in the pump body 1*a* and is fixed by a plurality of bolts.

An O-ring 61 is fitted into the pump body 1*a* for sealing between the high-pressure fuel supply pump mounting portion 90 and the pump body 1*a*, so as to prevent an engine oil from leaking to the outside.

A cylinder 6 for guiding the reciprocating motion of the plunger 2 and forming the pressurizing chamber 11 together with the pump body 1*a* is attached to the pump body 1*a*. In addition, the electromagnetic suction valve mechanism 300 for supplying the fuel to the pressurizing chamber 11 and the discharge valve mechanism 8 for discharging the fuel from the pressurizing chamber 11 to the discharge passage are provided.

A tappet 92 for converting a rotational motion of a cam 93 attached to a camshaft of the internal combustion engine into upward and downward motion and transmitting the upward and downward motion to the plunger 2 is provided at the lower end of the plunger 2 . The plunger 2 is pressure-bonded to the tappet 92 by a spring 4 through a retainer 15. Therefore, the plunger 2 can reciprocate upward and downward along with the rotational motion of the cam 93.

In addition, a plunger seal 13 held at a lower end portion of an inner periphery of a seal holder 7 is installed in a state of slidably contacting an outer periphery of the plunger 2. Therefore, when the plunger 2 slides, a fuel in a sub-chamber 7*a* is sealed and prevented from flowing into the internal combustion engine. At the same time, a lubricating oil (including an engine oil) lubricating a sliding portion in the internal combustion engine is prevented from flowing into the pump body 1*a*.

A suction joint 51 is attached to a side surface portion of the pump body 1*a* of the high-pressure fuel supply pump. The suction joint 51 is connected to a low-pressure pipe that supplies fuel from a fuel tank 20 of a vehicle, and the fuel is supplied from the suction joint 51 to the inside of the high-pressure fuel supply pump. A suction filter 52 in the suction joint 51 serves to prevent foreign matter existing between the fuel tank 20 and a low-pressure fuel suction port 10*a* from entering the high-pressure fuel supply pump by the flow of the fuel.

The fuel that has passed through the low-pressure fuel suction port 10*a* reaches the suction port 31*b* of the electromagnetic suction valve mechanism 300 through the pressure pulsation reduction mechanism 9 and a low-pressure fuel flow passage 10*d*.

A discharge valve mechanism 8 provided at an outlet of the pressurizing chamber 11 includes a discharge valve seat 8*a*, a discharge valve 8*b* that comes into contact with and separates from the discharge valve seat 8*a*, a discharge valve spring 8*c* that urges the discharge valve 8*b* toward the discharge valve seat 8*a*, a stopper 8*d* that determines a stroke (moving distance) of the discharge valve 8*b*, and a discharge valve pin 8*e* fixed to an inner peripheral surface of a hole provided in the stopper 8*d*. The discharge valve stopper 8*d* and the pump body 1*a* are welded and joined at an abutting portion 8*f* to shut off the fuel from the outside.

When there is no fuel pressure difference between the pressurizing chamber 11 and the discharge valve chamber 12*a*, the discharge valve 8*b* is pressure-bonded to the discharge valve seat 8*a* by a biasing force of the discharge valve spring 8*c* and is in a closed valve state. Only when the fuel pressure in the pressurizing chamber 11 becomes larger than the fuel pressure in the discharge valve chamber 12*a*, the discharge valve 8*b* opens against the discharge valve spring 8*c*. The high-pressure fuel in the pressurizing chamber 11 is discharged to the common rail 23 through the discharge valve chamber 12*a*, the fuel discharge passage 12*b*, and the fuel discharge port 12*c*. When the discharge valve 8*b* opens, it contacts the discharge valve stopper 8*d* and the stroke is limited. Therefore, the stroke of the discharge valve 8*b* is appropriately determined by the discharge valve stopper 8*d*. In addition, when the discharge valve 8*b* repeats the valve opening and closing motion, the discharge valve 8*b* guides on the outer peripheral surface of the discharge valve pin 8*e* so as to move only in a stroke direction. With the above configuration, the discharge valve mechanism 8 becomes a check valve that limits a flowing direction of the fuel.

As described above, the pressurizing chamber 11 includes the pump body 1*a*, the electromagnetic suction valve mechanism 300, the plunger 2, the cylinder 6, and the discharge valve mechanism 8.

<Suction Process>

When the plunger 2 moves in the direction of the cam 93 by the rotation of the cam 93 and is in a suction stroke state, the volume of the pressurizing chamber 11 increases and the fuel pressure in the pressurizing chamber 11 decreases. In this process, when the fuel pressure in the pressurizing chamber 11 becomes lower than the pressure in the suction port 31*b*, the suction valve 30 is in an open state. The fuel passes through an opening 30*e* of the suction valve 30 and flows into the pressurizing chamber 11.

<Return Process>

After the plunger 2 finishes the suction stroke, the plunger 2 turns into an upward movement and proceeds to a compression stroke. Here, the electromagnetic coil 43 is maintained in a non-energized state and a magnetic biasing force does not act. A rod biasing spring 40 is set to have a biasing force necessary and sufficient for maintaining the suction valve 30 open in the non-energized state. The volume of the pressurizing chamber 11 decreases with the compression motion of the plunger 2, but in this state, since the fuel sucked into the pressurizing chamber 11 is returned to the suction passage 10*d* again through the opening 30*e* of the suction valve 30 in the valve open state, the pressure in the pressurizing chamber never rises. This process is referred to as a return stroke.

<Discharge Process>

In this state, when a control signal from the ECU 27 is applied to the electromagnetic suction valve mechanism 300, a current flows through a terminal 46 to the electromagnetic coil 43. Then, the magnetic biasing force overcomes the biasing force of the rod biasing spring 40, and the rod 35 moves in a direction away from the suction valve 30. Therefore, the suction valve 30 is closed by the biasing force of the suction valve biasing spring 33 and the fluid force caused by the fuel flowing into the suction passage 10*d*. After the valve closing, the fuel pressure in the pressurizing chamber 11 rises together with the upward motion of the plunger 2, and when the pressure becomes equal to or higher than the pressure in the fuel discharge port 12*c*, the high-pressure fuel is discharged through the discharge valve mechanism 8 and supplied to the common rail 23. This stroke is referred to as a discharge stroke.

<Capacity Control>

As described above, the compression stroke (upward stroke between a lower start point and an upper start point) of the plunger 2 consists of the return stroke and the discharge stroke. The amount of the high-pressure fuel to be discharged can be controlled by controlling an energization timing of the coil 43 of the electromagnetic suction valve mechanism 300. When the timing of energizing the electromagnetic coil 43 is advanced, a rate of the return stroke during the compression stroke is small and a rate of the discharge stroke is large. That is, the amount of the fuel returned to the suction passage 10*d* is small, and the amount of the fuel to be discharged is large. On the other hand, when the energization timing is delayed, a ratio of the return stroke during the compression stroke is large and a rate of the discharge stroke is small. That is, the amount of the fuel returned to the suction passage 10*d* is large, and the amount of the fuel discharged at a high pressure is small. The timing of energizing the electromagnetic coil 43 is controlled by a command from the ECU 27.

By controlling the timing of energizing the electromagnetic coil 43 as described above, it is possible to control the amount of the fuel to be discharged at a high pressure to the amount required by the internal combustion engine.

<Pressure Pulsation Reduction>

A low-pressure fuel chamber 10 is provided with a pressure pulsation reduction mechanism 9 that reduces a pressure pulsation generated in the high-pressure fuel supply pump from spreading to the fuel pipe 28. Once the fuel that has flown into the pressurizing chamber 11 is returned to the suction passage 10*d* again through the suction valve 30 that is in the open valve state for capacity control, pressure pulsation occurs in the low-pressure fuel chamber 10 due to the fuel returned to the suction passage 10*d*. However, the pressure pulsation reduction mechanism 9 provided in the low-pressure fuel chamber 10 is formed by a metal diaphragm damper in which two disk-shaped metal plates in a corrugated form are laminated on the outer periphery thereof and an inert gas such as argon is injected into the inside, and the pressure pulsation is absorbed and reduced by the expansion and contraction of the metal damper.

The plunger 2 has a large diameter portion 2*a* and a small diameter portion 2*b*, and a volume of a sub-chamber 7*a* is increased or decreased by the reciprocating motion of the plunger. The sub-chamber 7*a* communicates with the low-pressure fuel chamber 10 through the fuel passage 10*e*. When the plunger 2 moves downward, the flow of the fuel is generated from the sub-chamber 7*a* to the low-pressure fuel chamber 10, and when the plunger 2 moves upward, the flow of the fuel is generated from the low-pressure fuel chamber 10 to the sub-chamber 7*a*.

Therefore, it is possible to have a function of reducing the flow rate of fuel to the inside and outside of the pump during the suction stroke or the return stroke of the pump and reducing the pressure pulsation generated inside the high-pressure fuel supply pump.

The operation of the relief valve mechanism will be described in detail. The relief valve mechanism 100 for limiting the flow of the fuel in the relief passage 100*a* in only one direction from the fuel discharge port 12*c* to the pressurizing chamber 11 is provided in the pump body 1. As illustrated, the relief valve mechanism 100 includes a relief valve 101, a relief valve holder 102, a relief valve seat 103, a relief spring stopper 104, and a relief spring 105. After the relief valve 101 is inserted into the relief valve seat 103, the relief valve 101 is held by the relief valve holder 102, the position of the relief spring stopper 104 is regulated such that the relief spring 105 has a desired load, and the relief valve 101 is fixed to the relief valve seat 103 by press fitting or the like. The valve opening pressure of the relief valve 101 is regulated by a pushing force of the relief spring 105. When a pressure difference between the inside of the pressurizing chamber 11 and the inside of the relief passage 100*a* becomes equal to or higher than a specified pressure, the relief valve 101 is set apart from the relief valve seat 103 and opened.

The relief valve mechanism 100 unitized as described above is fixed by press-fitting the relief valve seat 103 into an inner peripheral wall of a cylindrical through-hole 1*c* provided in the pump body 1. Then, the fuel discharge port 12*c* is fixed so as to close the cylindrical through-hole 1*c* of the pump body 1 to prevent the fuel from leaking from the high-pressure pump to the outside and enable the connect to the common rail.

When the volume of the pressurizing chamber 11 starts to decrease due to the movement of the plunger 2, the pressure in the pressurizing chamber increases as the volume decreases. Then, when the pressure in the pressurizing chamber 11 finally becomes higher than the pressure in the discharge flow passage 12*b*, the discharge valve mechanism 8 opens the valve and the fuel is discharged from the pressurizing chamber 11 to the discharge flow passage 12*b*. Immediately afterwards from the moment when the discharge valve mechanism 8 opens the valve, the pressure in the pressurizing chamber overshoots to a very high pressure. The high pressure also propagates into the discharge flow passage 12*b*, and the pressure in the discharge flow passage 12*b* also overshoots at the same timing.

If the outlet of the relief valve mechanism 100 is connected to a suction flow passage 10*b*, a pressure difference between the inlet and the outlet of the relief valve 101 becomes larger than the valve opening pressure of the relief valve mechanism 100 due to the pressure overshoot in the discharge flow passage 12*b*, and the relief valve malfunctions. On the other hand, in the embodiment, since the outlet of the relief valve mechanism 100 is connected to the pressurizing chamber 11, the pressure in the pressurizing chamber 11 acts on the outlet of the relief valve mechanism 100, and the pressure in the discharge flow passage 12*b* acts on the inlet of the relief valve mechanism 100. Since the pressure overshoot occurs at the same timing in the pressurizing chamber 11 and the discharge flow passage 12*b*, a pressure difference between the inlet and the outlet of the relief valve does not become equal to or higher than the valve opening pressure of the relief valve. That is, the relief valve does not malfunction.

The cylinder structure of the present embodiment will be described in detail with reference to FIGS. 1 and 7.

The pump body 1 is provided with the pump body 1*a* in which the pressurizing chamber 11 is formed, and the cylinder 6 which is inserted into a cylinder fitting hole 6*f* formed in the pump body 1*a* and is formed in a cylindrical shape. In addition, the fuel is pressurized in the pressurizing chamber 11 during the upward stroke of the plunger 2. At this time, the pressure generated in the pressurizing chamber 11 becomes approximately 70 MPa at an instantaneous pressure. A force in a downward direction in the drawing acts on the pressurized fuel in the cylinder end surface 6*d* of the large diameter portion 6*b* of the cylinder 6, and as a result, the pump body 1*a* and the cylinder end surface 6*d* of the cylinder 6 are separated from each other, and the fuel leaks into the sub-chamber 7*a* formed by the seal holder 7 and the lower end of the cylinder. Therefore, a bonding strength in an axial direction of the cylinder 6 is set to be higher than a force generated during an upward movement process and acting downward in the drawing.

Details of the seal portion will be described with reference to FIGS. 7 to 9.

Figure 7:
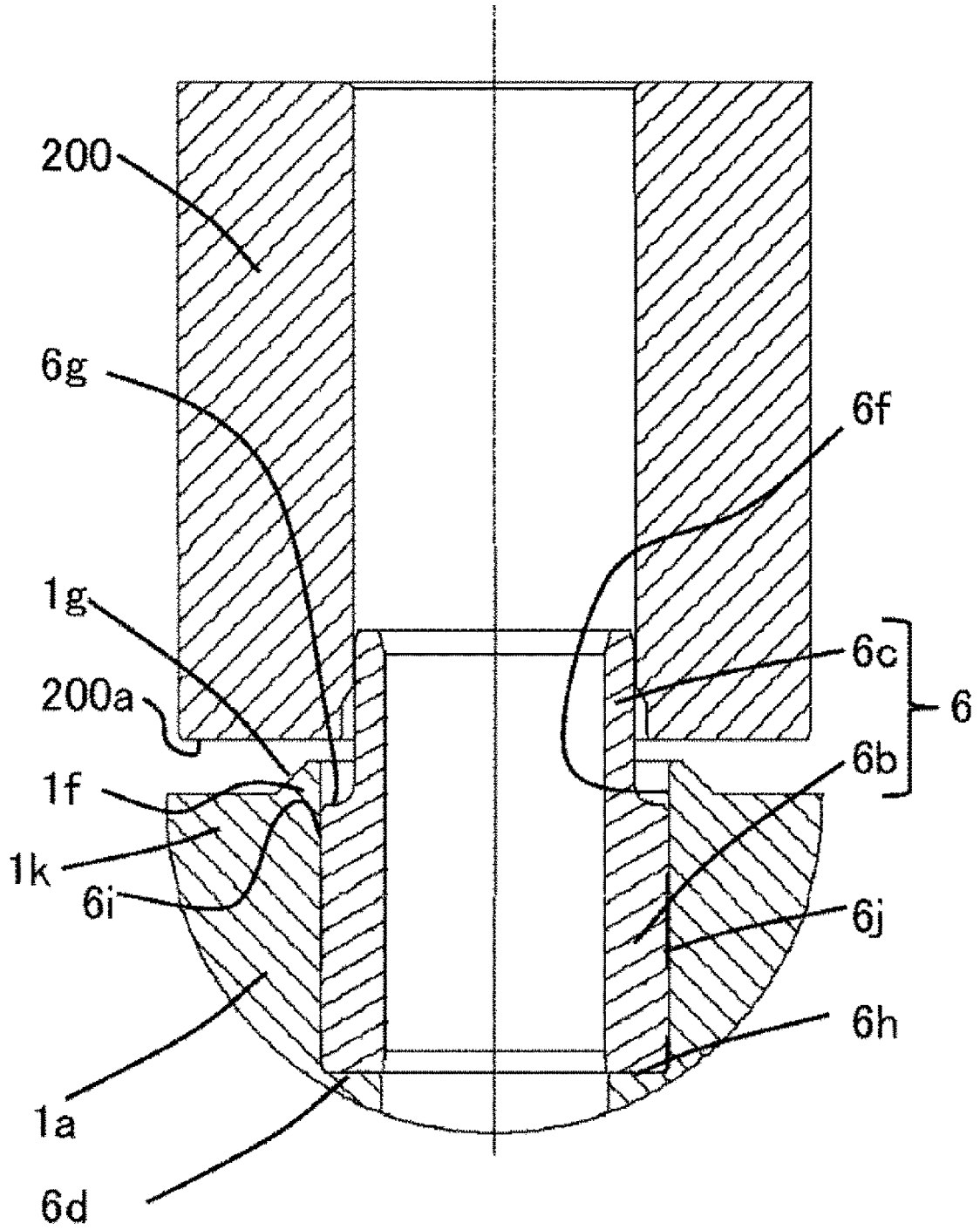
FIG. 7 illustrates a state before a cylinder is caulked to a pump body.

FIG. 7 illustrates a state in which the cylinder 6 is assembled to the pump body 1*a*. When assemble as illustrated in FIG. 7, the pressurizing chamber 11 side of the pump body 1*a* is directed downward in a manner opposite to that illustrated in FIG. 1, and the cylinder fitting hole 6*f* is arranged so as to open upward. The cylinder fitting hole 6*f* into which the cylinder 6 is inserted is formed in the pump body 1*a*. It may be said that the cylinder fitting hole 6*f* and a cylinder side surface 6*j* are fitted together. In addition, a stepped portion is formed on the side of the pressurizing chamber 11 of the pump body 1*a*, and a cylinder fitting hole bottom surface 6*h* held in contact with the cylinder end surface 6*d* at the tip of the cylinder 6 on the side of the pressurizing chamber 11 is formed. A protrusion 6*e* protruding from the cylinder 6 toward the cylinder fitting hole bottom surface 6*h* is locally formed on the cylinder end surface 6*d*. Since the protrusion 6*e* is formed in an annular shape along with the circumferential shape of the cylinder, and the protrusion 6*e* is referred to as an annular protrusion 6*e* in this embodiment.

When the cylinder end surface 6*d* of the cylinder 6 is pressure-bonded to the cylinder fitting hole bottom surface 6*h*, the annular protrusion 6*e* is pressure-bonded to and brought into close contact with the cylinder fitting hole bottom surface 6*h*, such that the fuel pressurized in the pressurizing chamber 11 is sealed so as not to leak to the low pressure side. It may be said that the annular protrusion 6*e* bites into the cylinder fitting hole bottom surface 6*h*.

In order to support the reciprocating motion of the plunger 2, the material of the cylinder 6 is selected to be equal to or higher than a material hardness of the pump body 1*a*. Therefore, since the annular protrusion 6*e* bites into the pump body 1*a* and the pump body 1*a* is plastically deformed, the sealing function of the cylinder end surface 6*d* can be further enhanced. In the present embodiment, the shape of the annular protrusion 6*e* is triangular, but the same effect can also be expected for a convex shape, a curved shape, and the like.

A method of plastic bonding the pump body 1*a* and the cylinder 6 will be described in more detail with reference to FIGS. 7 to 10 and 13.

FIG. 7 illustrates a state in which the cylinder 6 is assembled in the cylinder fitting hole 6*f* of the pump body 6, and 200 is a punch to which a load is applied by a pressurizing device such as a press machine. A convex portion 1*f* that is convex on the side opposite to the insertion direction of the cylinder 6 (hereinafter simply referred to as "insertion direction") is formed at the end portion 1*k* of the pump body 1*a* on the side opposite to the pressurizing chamber 11. The insertion direction of the cylinder 6 is from top to bottom in FIG. 7 and is from bottom to top in FIG. 1. The convex portion 1*f* is compressed in the axial direction of the cylinder 6 in the same direction as the insertion direction by the punch pressurizing surface 200*a* and starts plastic deformation, and the convex portion 1*f* is deformed toward the inner peripheral side of the cylinder 6 as the punch 200 moves downward. The direction toward the center axis of the plunger 2 with respect to the cylinder 6 is referred to as an inner peripheral side, and the opposite direction is referred to as an outer peripheral side.

An inner peripheral end surface of the convex portion 1*f* before deformation is positioned on the outer peripheral side of the cylinder side surface 6*j* such that the cylinder 6 can be inserted into the cylinder fitting hole 6*f* of the pump body 1*a*. In FIG. 7, the cylindrical cylinder 6 includes a large diameter portion 6*b* on the pressurizing chamber side and a small diameter portion 6*c* on the side opposite to the pressurizing chamber side. In other words, in the cylinder 6, the small diameter portion 6*c* and the large diameter portion 6*b* are formed in sequence in the insertion direction.

Since the pressurizing punch 200 can pressurize and plastically deform only the convex portion 1*f* of the pump body 1*a* with a part of the flat surface of the punch 200, the stiffness of the punch 200 can be increased. Therefore, even in the case of using quenched die steel as the material of the punch 200, a high-strength material having a tensile strength of about 1,000 MPa can be pressurized and plastically bonded, and breakage of the punch 200 can be prevented.

Here, most of the convex portion 1*f* of the pump body 1*a* plastically flows, but since the punch pressurizing surface 200*a* is pressurized in the same direction as the insertion direction of the cylinder 6 in the axial direction, compression stress is applied to the entire convex portion 1*f* and the convex portion 1*f* is compressively deformed. At this time, the outer peripheral side of the convex portion 1*f* before deformation is an inclined surface 1*g* spreading to the outer peripheral side as it goes in the pressurizing direction (insertion direction of the cylinder 6). That is, the inclined protrusion 1*g* widens toward the pressurizing direction.

Therefore, when the convex portion 1*f* is pressurized by the punch pressurizing surface 200*a*, the convex portion 1*f* can be hardly deformed in the outer peripheral direction, such that the convex portion 1*f* is plastically deformed while compression stress is applied in the inner peripheral direction. Furthermore, since the convex portion 1*f* and the vicinity of the lower portion of the convex portion 1*f* can be plastically deformed as a whole without causing local slip under compression stress, plastic bonding can be achieved even with a material having an elongation of 10% or less (for example, aluminum die casting), without occurrence of cracks.

After the large diameter portion 6*b* of the cylinder 6 is inserted into the cylinder fitting hole 6*f* and the convex portion 1*f* is deformed, the convex portion 1*f* is deformed such that the inner peripheral side end surface of the deformed convex portion 1*f* is located on the inner peripheral side with respect to the cylinder side surface 6*j*. When the end portion of the outer peripheral side end portion of the large diameter portion 6*b* of the cylinder 6 and the end portion on the side opposite to the insertion direction are referred to as a cylinder shoulder portion 6*g*, the deformed convex portion 1*f* is finally plastically deformed so as to cover the cylinder shoulder portion 6*g* as illustrated in FIG. 8.

As described above, on the end portion 1*k* of the pump body 1*a* opposite to the pressurizing chamber 11, a protrusion (convex portion 1*f* after deformation) formed from the outer peripheral side to the inner peripheral side is provided with respect to the inner peripheral surface facing the outer peripheral surface (cylinder side surface 6*j*) of the cylinder 6 (the inner peripheral surface of the cylinder fitting hole 6*f*). In addition, as illustrated in FIG. 8, the protrusion (convex portion 1*f* after deformation) is formed so as to protrude toward the inner peripheral side of the cylinder 6 from the cylinder side surface 6*j*. In addition, the protrusion (convex portion 1*f* after deformation) is formed so as to protrude to the side opposite to the pressurizing chamber 11 with respect to the flat portion of the end portion 1*k* of the pump body 1*a*, and the cylinder 6 is supported from the side opposite to the pressurizing chamber 11.

Figure 8:
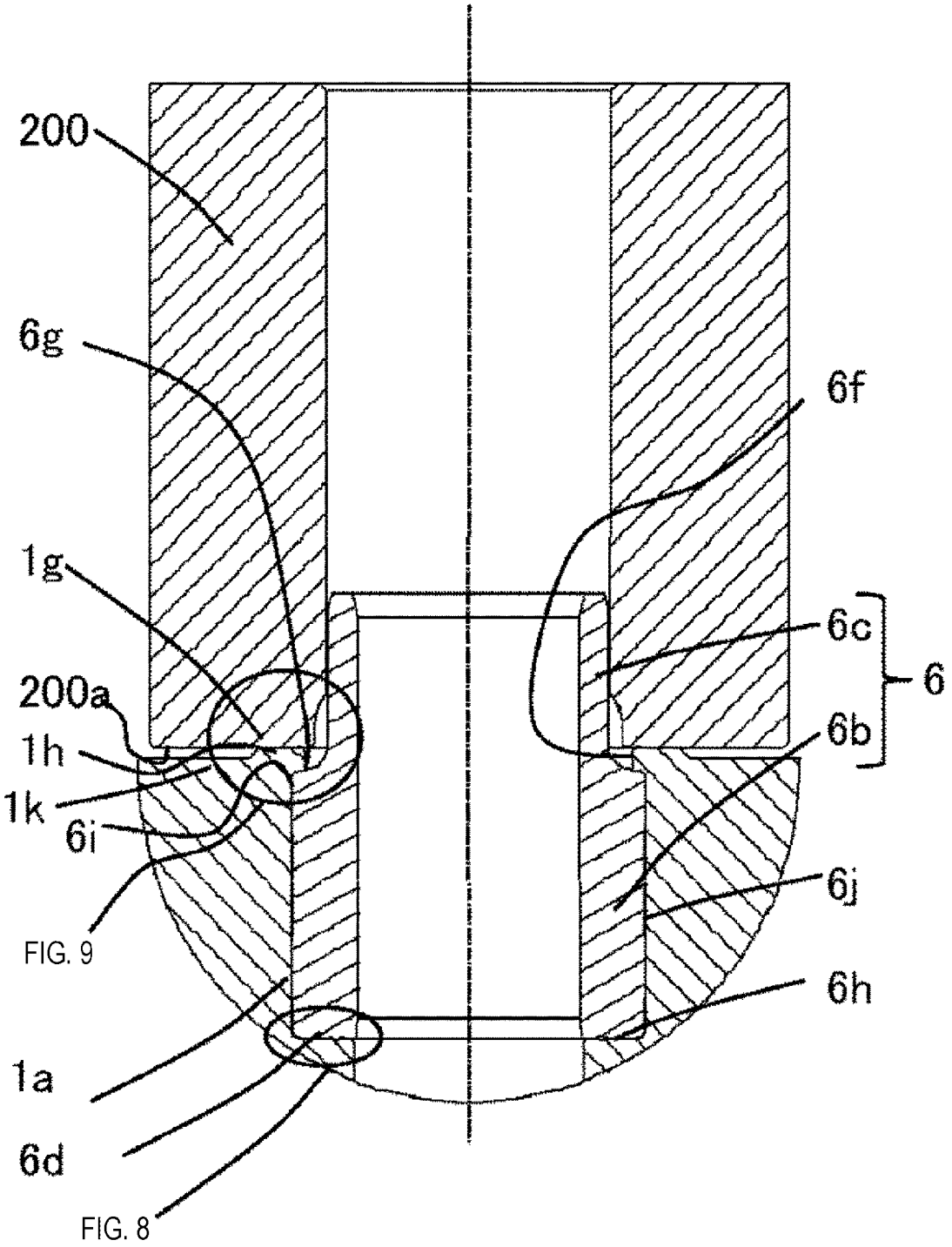
FIG. 8 illustrates a state after a cylinder is caulked to a pump body.
Figure 9:
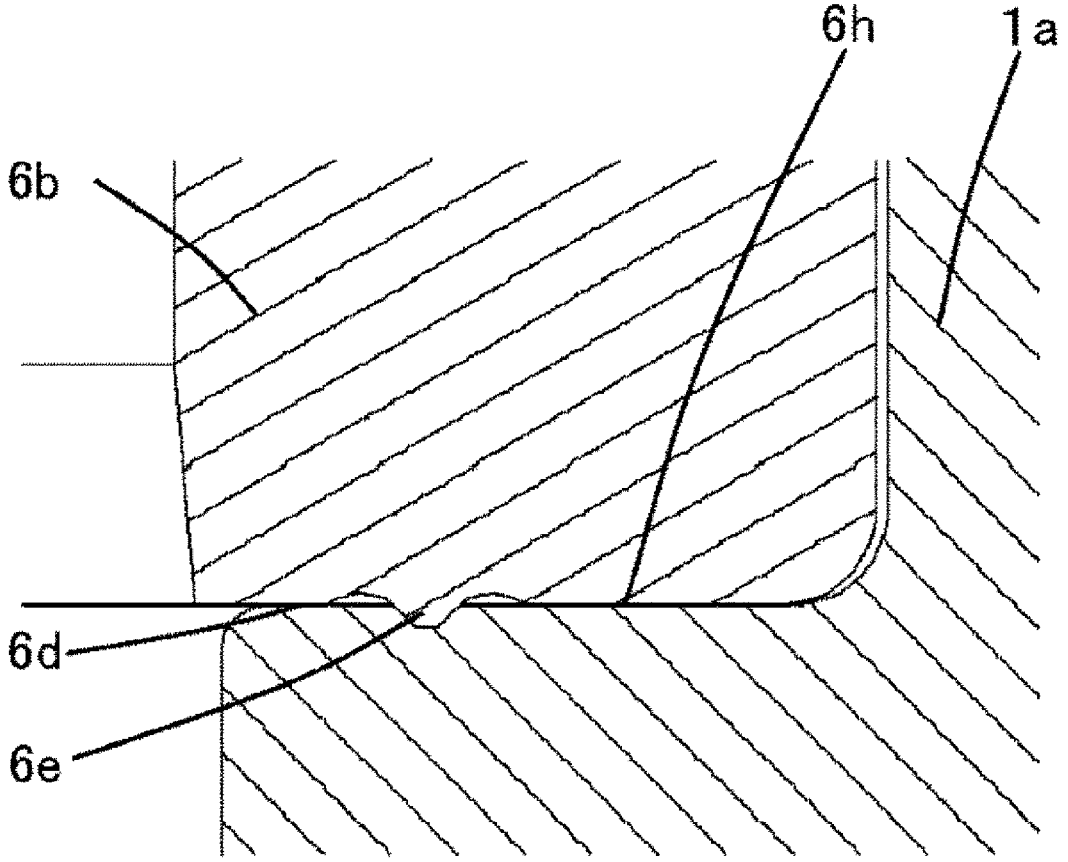
FIG. 9 illustrates a detailed shape of an annular protrusion.
Figure 10:
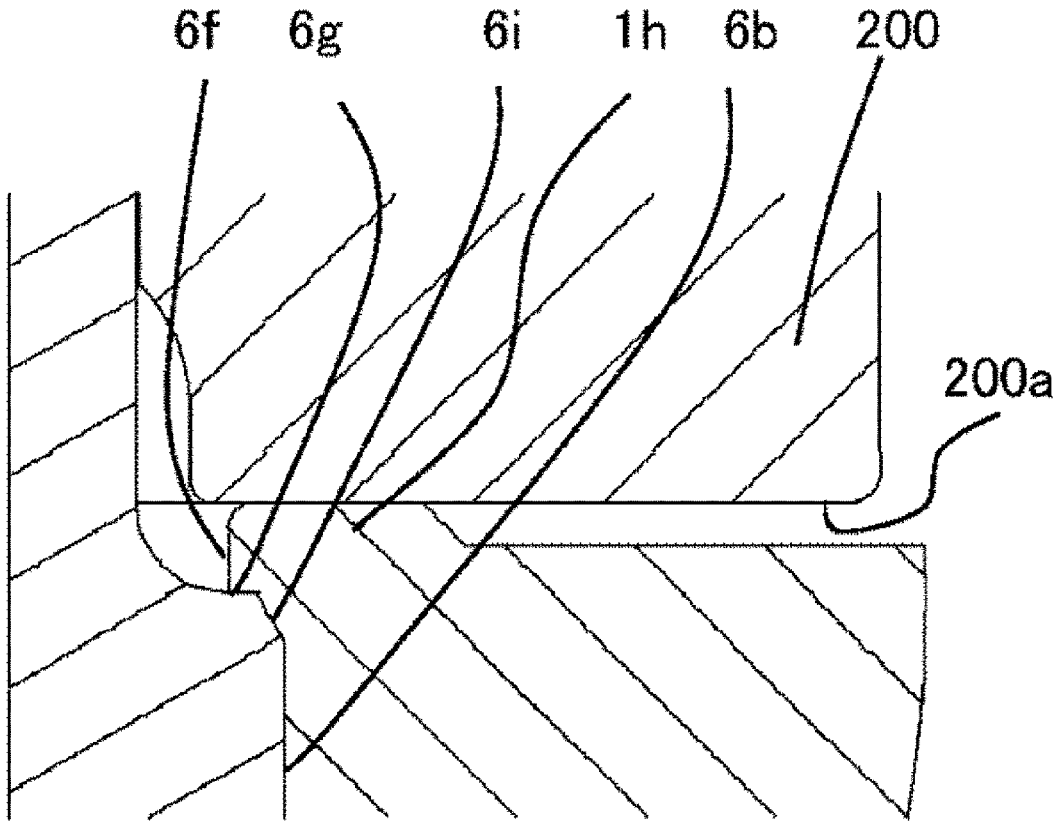
FIG. 10 illustrates a detailed shape of a cylinder shoulder portion.

In addition, as illustrated in FIG. 8, a taper 1*g* is formed so as to be inclined in a direction opposite to the pressurizing chamber 11 (direction opposite to the insertion direction) as the outer peripheral portion of the protrusion (convex portion 1*f* after deformation) moves from the flat portion of the end portion 1*k* of the pump body 1*a* toward the inner peripheral side. In addition, the inner peripheral portion of the protrusion (convex portion 1*f* after deformation) is formed so as to be inclined inwardly from the inner peripheral surface (inner peripheral surface of the cylinder fitting hole 6*f*) facing the outer peripheral surface (cylinder side surface 6*j*) of the cylinder 6 toward the side opposite to the pressurizing chamber 11 (direction opposite to the insertion direction). Then, the cylinder 6 is supported by the side surface of the pressurizing chamber at the inner peripheral portion of the protrusion (convex portion 1*f* after deformation). In addition, when a pressure is applied to the protrusion (convex portion 1*f* before deformation) of the pump body 1*a* in the insertion direction from the side opposite to the pressurizing chamber 11, the protrusion (convex portion 1*f* after deformation) contacts a side surface of an anti-pressurizing chamber (cylinder shoulder portion 6*g*) of the cylinder 6.

In the cylinder shoulder portion 6*g* of the large diameter portion 6*b* of the cylinder 6, a tapered portion 6*i* is formed so as to be inclined toward the inner peripheral side as it goes in a direction opposite to the cylinder insertion direction. Therefore, a wedge-shaped gap is provided between the cylinder side surface 6*j* and the cylinder fitting hole 6*f* and at the intersection of the cylinder side surface 6*j* and the cylinder shoulder portion 6*g* before the deformation of the convex portion 1*f*. Therefore, since the amount of plastic deformation of the pump body 1*a* is increased, work hardening is increased and material strength can be improved. In addition, since the flow of the material is constrained by the tapered surface 6*i*, internal stress can be increased. On the other hand, when a pull-out force in the axial direction is applied to the cylinder 6, the material plastically flowing through the tapered portion 6*i* is shaped like a wedge, and thus, a reaction force from the outer peripheral direction can be generated as well as in a pull-out direction. As described above, the pull-out force and the residual deflection of the cylinder 6 can be increased by the tapered surface 6*i*.

At this time, the load of the pressurizing device is also transmitted in the axial direction of the cylinder 6 through the plastic deformation, the protrusion 6*e* provided on the cylinder end surface 6*d* plastically deforms and bites into the cylinder fitting hole bottom surface 6*h*, and the cylinder end surface 6*d* and the cylinder fitting hole bottom surface 6*h* are pressure-bonded. In terms of sealability between the pump body 1*a* and the cylinder 6, the cylinder fitting hole bottom surface 6*h* and the cylinder end surface 6*d* are pressure-bonded, and the protrusion 6*e* plastically deforms and bites into the cylinder fitting hole bottom surface 6*h*. Therefore, the surface roughness of the protrusion 6*e* is transferred to the surface roughness of the cylinder fitting hole bottom surface 6*h*, the protrusion 6*e* and the cylinder fitting hole bottom surface 6*h* are sufficiently contacted to seal the fluid without being affected by the surface roughness of the cylinder fitting hole bottom surface 6*h* and the component accuracy such as the right angle between the pump body 1*a* and the cylinder 6, and it is possible to remarkably improve the fuel sealability.

Figure 13:
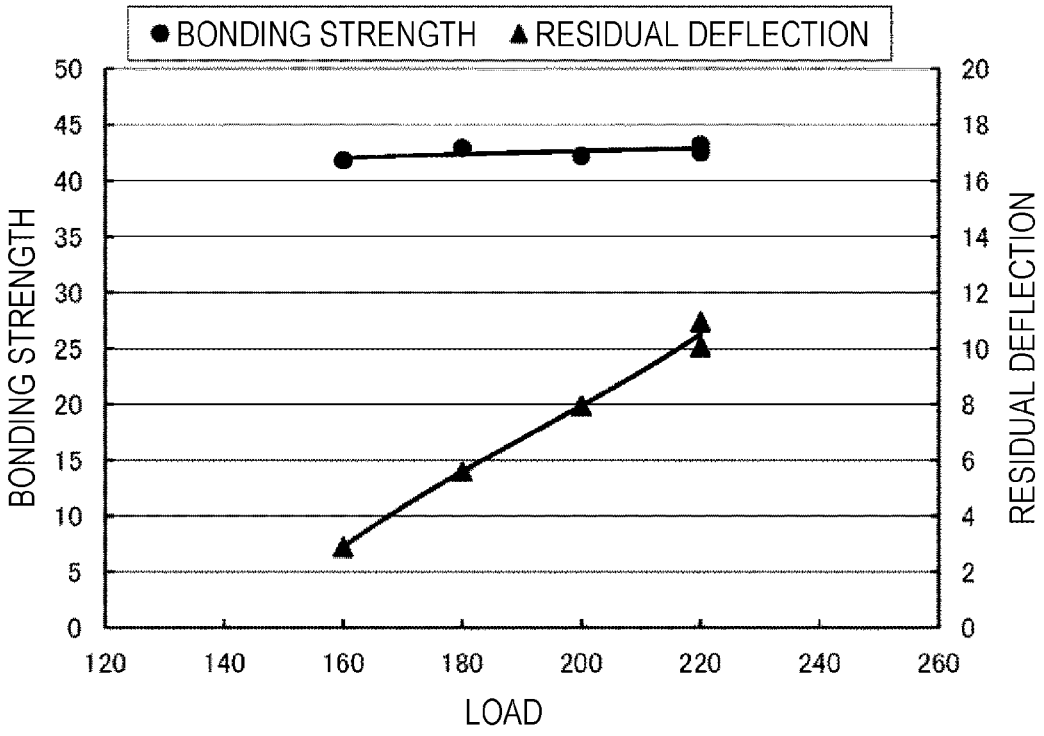
FIG. 13 illustrates a relationship between a load, a cylinder bonding strength, and a residual deflection.

FIG. 13 illustrates a relationship between the load, the bonding strength of the cylinder 6, and the residual deflection. As for the bonding strength, the load is almost constant between 160 and 220, but the residual strain increases with the load. This is considered to be a difference in work hardening due to the plastic deformation of the pump body 1*a*, and in particular, it is considered that the yield stress of the material of the pump body 1*a* increases as the work hardening of the portion to be pressure-bonded to the tapered surface 6*i* increases.

As described above, the material of the pump body 1*a* covers over the cylinder shoulder portion 6*g* by the plastic bonding and is pressure-bonded to the cylinder shoulder portion 6*g*, the tapered surface 6*i* of the cylinder 6, and the cylinder side surface 6*j* by the residual stress, and furthermore, the axial direction of the cylinder 6 is held while being pressure-bonded by the plastic bonding portion 1*h* and the cylinder fitting hole bottom surface 6*h* and is firmly fixed to the cylinder 6.

Figure 11:
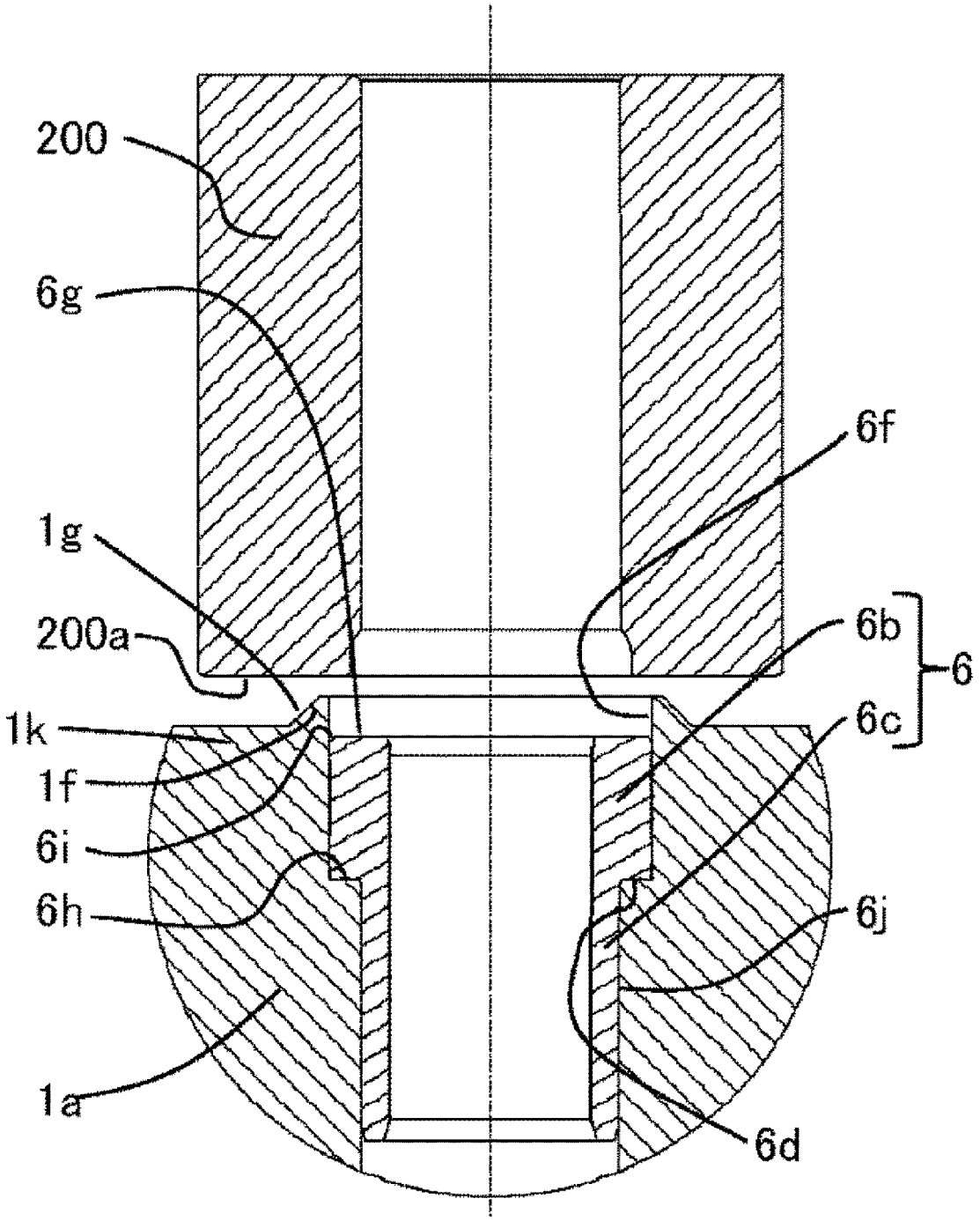
FIG. 11 illustrates a state before caulking of another cylinder shape.
Figure 12:
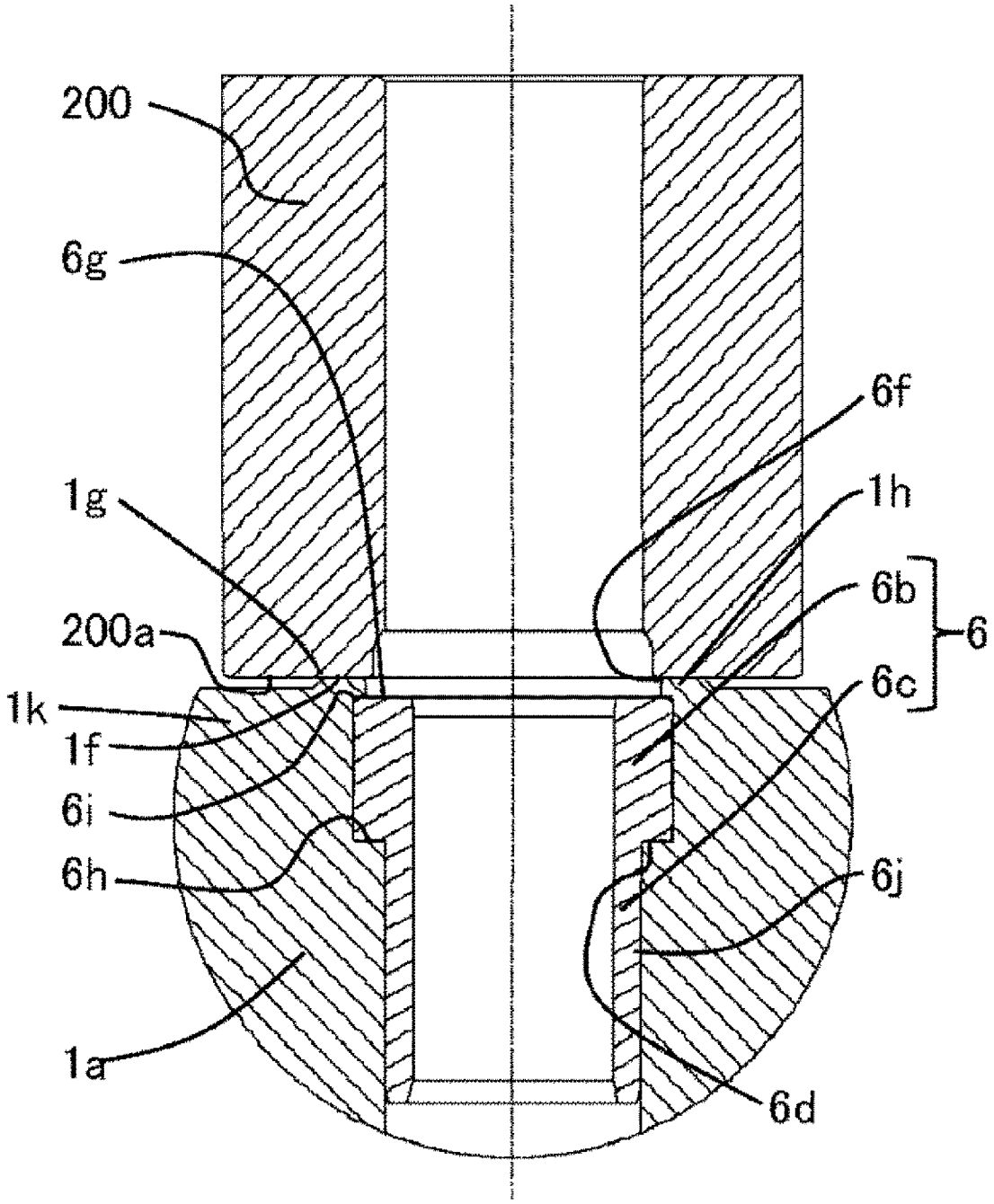
FIG. 12 illustrates a state after caulking of another cylinder shape.

FIGS. 11 and 12 illustrate another embodiment of the cylinder.

Figure 6:
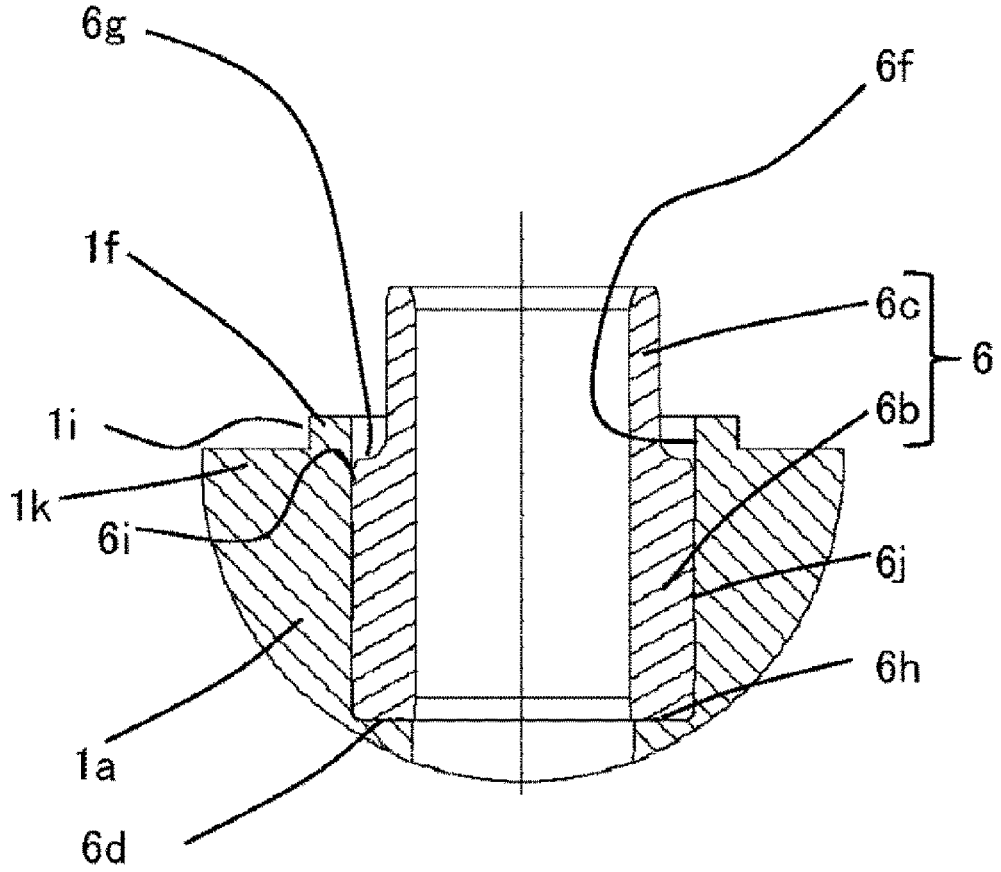
FIG. 6 illustrates another shape of the convex portion.

In FIG. 11, in the cylinder 6 formed in a cylindrical shape, a small diameter portion 6*c* forms a pressurizing chamber side, and a large diameter portion 6*b* forms an anti-pressurizing chamber side, contrary to FIG. 7. In FIG. 6, the inner diameter of the cylinder fitting hole 6*f* is formed to be substantially the same as that of the large diameter portion 6*b*, and the inner peripheral surface of the inner diameter passes through the stepped portion (cylinder fitting hole bottom surface 6*h*) and is configured to communicate with the pressurizing chamber 11. On the other hand, in FIG. 11, the point that the inner diameter of the cylinder fitting hole 6*f* is formed to be substantially the same as that of the large diameter portion 6*b* is the same as in FIG. 7, but an inner peripheral surface having a smaller diameter than the inner diameter of the cylinder fitting hole 6*f* is formed on the pressurizing chamber 11 side. That is, the cylinder fitting hole 6*f* is formed by connecting a first inner peripheral surface having a large inner diameter on a semi-pressurizing chamber side and a second inner peripheral surface having a small inner diameter on the pressurizing chamber side. The second inner peripheral surface is configured to communicate with the pressurizing chamber 11.

The cylinder 6 is inserted into the pump body 1*a* and the cylinder fitting hole 6*f* formed in the pump body 1*a*. More specifically, the small diameter portion 6*c* of the cylinder 6 is fitted and inserted into the second inner peripheral surface, and the large diameter portion 6*b* is fitted and inserted into the first inner peripheral surface. The convex portion 1*f* (protrusion) provided in advance at the periphery of the inlet of the cylinder fitting hole 6*f* of the pump body 1*a* is pressurized in the insertion direction of the cylinder and thus compressively deformed. At this time, the materials of the convex portion 1*f* and the vicinity of the convex portion 1*f* are plastically deformed toward the cylinder 6. Specifically, the materials of the convex portion 1*f* and the vicinity of the convex portion 1*f* are plastically deformed toward the inner peripheral side. Therefore, the convex portion 1*f* is plastically bonded and fixed so as to pressure-bond and cover the cylinder shoulder portion 6*g* and the cylinder side surface 6*j*.

As in FIG. 7, the outer peripheral side of the convex portion 1*f* before deformation is an inclined surface 1*g* spreading to the outer peripheral side as it goes in the pressurizing direction (insertion direction of the cylinder 6). That is, the inclined surface 1*g* widens toward the pressurizing direction. Even after deformation, the inclined surface 1*g* spreading to the outer peripheral side is formed on the outer peripheral side of the convex portion 1*f* toward the pressurizing direction (insertion direction of the cylinder 6). Before and after deformation, the convex portion 1*f* (protrusion) is formed in a ring shape on the periphery of the pump body 1*a*. In addition, the same reference numerals as those in FIG. 7 have the same functions, and a description thereof will be omitted.

Further, the cylinder fitting hole 6*f* of the pump body 1*a* has the cylinder fitting hole bottom surface 6*h*, the cylinder end surface 6*j* coming into contact with the cylinder fitting hole bottom surface 6*h* is pressure-bonded to the cylinder fitting hole bottom surface 6*h* by pressurization, and the local annular protrusion 6*e* provided at the stepped portion between the large diameter portion 6*b* and the small diameter portion 6*c* of the cylinder 6 is pressed and brought into close contact with the cylinder fitting hole bottom surface 6*h* such that the pressurized fuel in the pressurizing chamber 11 is sealed so as not to leak to the low pressure side.

Figure 5:
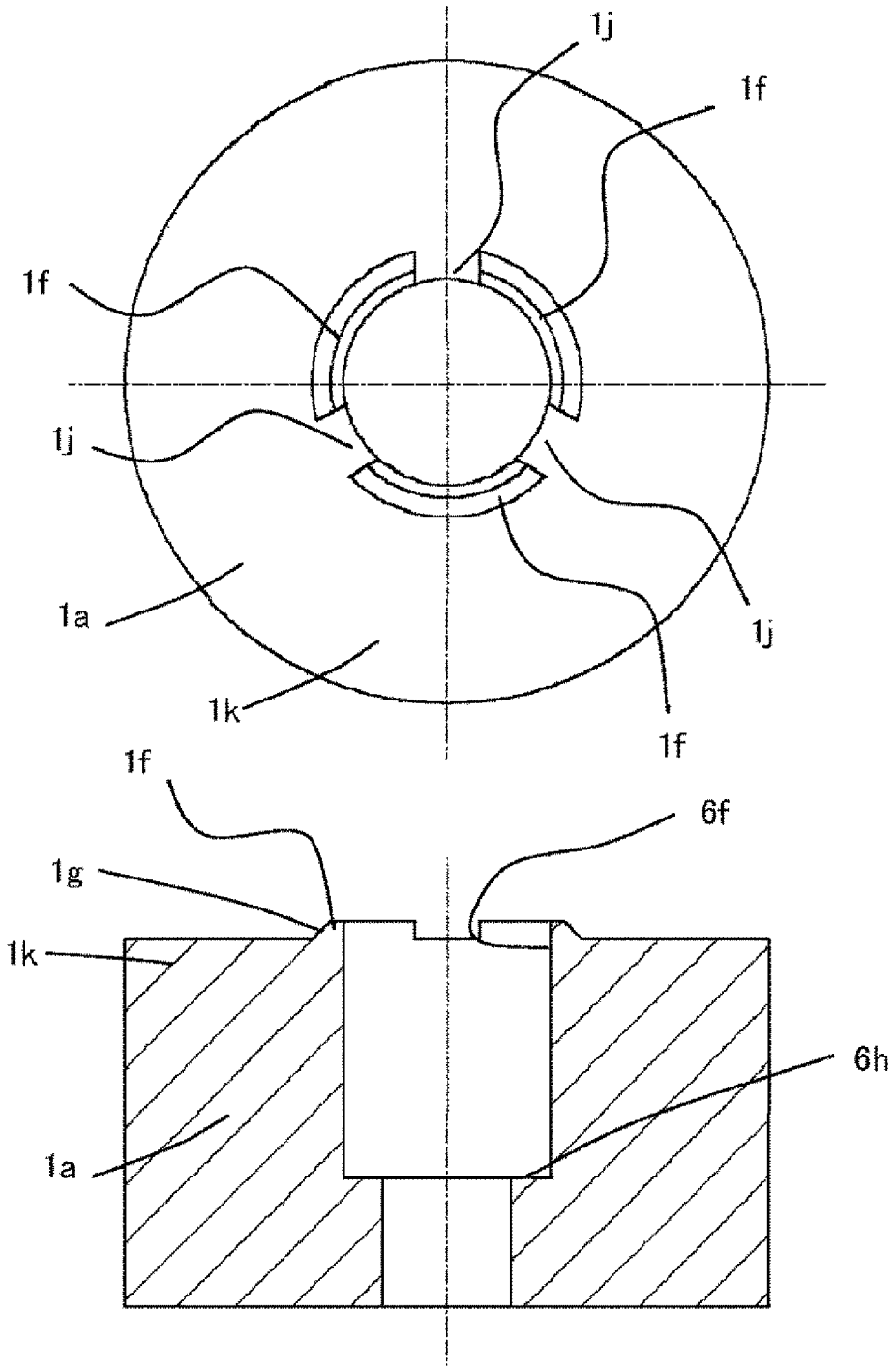
FIG. 5 illustrates a shape of a convex portion having three discontinuous portions.

Another shape of the convex portion 1*f* of the present embodiment will be described with reference to FIGS. 5 and 6.

In the convex portion 1*f* of the present embodiment, the convex portion 1*f* of the pump body 1*a* has a ring shape, but the same effect can be expected for the convex portion 1*f* having one or more discontinuous portions 1*j*. That is, the protrusion (convex portion i*f*) is formed so as to protrude to the side opposite to the pressurizing chamber 11 with respect to the flat portion of the end portion 1*k* of the pump body 1*a*, but may be configured so as to protrude only a part even if it does not protrude over the entire region on the periphery. By forming the discontinuous portion, the amount of the plastic process can be reduced, such that the load to be deformed can be reduced, and as a result, the effect of suppressing the deformation of the pump body 1*a* to other portions can be expected. The same effect can be expected even if the inclined surface 1*g* is a vertical surface 11. FIG. 5 illustrates an example of the convex portion 1*f* having three discontinuous portions 1*j*.

As described above, in the method of manufacturing the high-pressure fuel supply pump of the present embodiment, the cylinder 6 is fitted into the cylinder fitting hole 6*f* having the cylinder fitting hole bottom surface 1*h* of the pump body 1*a*. The convex portion 1*f* previously provided on the peripheral portion of the entrance of the cylinder fitting hole 6*f* of the pump body 1*a* is a pressurizing surface 200*a* of the punch 200, and moreover, a part of the punch end surface apart from the side surface of the punch 200 is compressively deformed by being pressurized in the substantially axial direction of the cylinder (insertion direction), and the materials of the convex portion 1*f* and the vicinity of the convex portion 1*f* are plastically deformed in the cylinder direction (inner peripheral side). Therefore, it is pressure-bonded to the cylinder shoulder portion and the cylinder side surface 6*j* and plastically bonded to cover it. The cylinder end surface 6*d* contacting the cylinder fitting hole bottom surface 6*h* of the cylinder 6 is pressure-bonded to the cylinder fitting hole bottom surface 6*h* by pressurization, and the local protrusion 6*e* provided on the cylinder end surface 6*d* plastically deforms the cylinder fitting hole bottom surface 6*h* and bites into the cylinder fitting hole bottom surface 6*h* such that the biting portion is pressure-bonded and brought into close contact therewith to perform the sealing.

In the above, the method of inserting the cylinder 6 into the cylinder fitting hole 6*f* of the pump body 1*a* and fixing the cylinder 6 has been described. However, the object of the present embodiment is to provide a method of bonding two members, in which no cracks in the caulking portion even when a high-strength material having a high deformation resistance and little elongation or a material having a low deformation resistance but low elongation is used, and furthermore, and a plastic bonding (for example, caulking coupling) is performed to prevent the breakage of the pressurizing jig (punch) when caulking coupling a high-strength material that has a high deformation resistance and is likely to break a pressurizing jig (punch).

Therefore, the bonding and fixing method of the present embodiment is not necessarily limited to the high-pressure fuel supply pump, and can also be applied to the case of bonding other two members. That is, in the method of bonding two members, a fitting portion is a fitting part having a cylindrical shape which is fitted into a body having a bottomed hole and a fitting portion fitted in the bottomed hole, the fitting part is fitted into the bottomed hole of the body, and a convex portion provided in advance at the peripheral portion of the entrance of the bottomed hole of the body is pressurized in the substantially axial direction (insertion direction) of the fitting part. Therefore, the convex portion is compressively deformed, and the materials of the convex portion and the vicinity of the convex portion are plastically deformed in the direction of the fitting part, and the convex portion is fixed and bonded so as to cover over the shoulder portion of the fitting part and the fitting portion side surface of the fitting part while being pressure-bonded. In addition, it is desirable that the outer peripheral side of the convex portion is a surface divergent from the pressurizing direction. In addition, it is desirable to pressurize the convex portion in the substantially axial direction (insertion direction) of the fitting part with a part of the punching end surface that is the pressurizing surface of the punch and further away from the side surface of the punch.

According to the present embodiment described above, since the cylinder and the body can be plastically bonded to each other by compressive deformation not positively subjected to shearing processing in the convex portion and the vicinity of the convex portion, cracks hardly occur in the plastic bonding portion even with a material having a small elongation. In addition, since the stiffness of the plastically deformed portion is lowered by using the plastically deformed portion of the body as the convex portion, the deformation resistance of the plastic bonding can be lowered.

On the other hand, in the punch to be pressurized, it is unnecessary to make only the pressurizing portion locally convex like the punch of PTL 2, such that only the convex portion of the body is pressurized by a part of the flat surface of the punch. Therefore, since the stiffness of the punch can be increased, the breakage of the punch can be prevented even if the high-strength material is pressurized.

In addition, in terms of the sealability between the body and the cylinder, the cylinder fitting hole bottom surface and the cylinder end surface are pressure-bonded and the protrusion plastically deforms and bites into the cylinder fitting hole bottom surface. Therefore, the surface roughness of the protrusion is transferred to the surface roughness of the cylinder fitting hole bottom surface, the protrusion and the cylinder fitting hole bottom surface can be sufficiently brought into close contact to seal the fluid without being affected by the component accuracy such as the surface roughness of the cylinder fitting hole bottom surface or the right angle between the body and the cylinder. Therefore, it is possible to remarkably improve the fuel sealability.

As described above, it is possible to provide the high-pressure fuel supply pump that can make the bonding structure of the cylinder and the body compact with excellent sealing performance by plastic bonding, and can make the pump body reduced in size, reduced in cost, and highly reliable.

In addition, this bonding method can be widely applied as a method of bonding two members without being limited to a high-pressure fuel supply pump, and in particular, it is extremely effective for plastically bonding materials with low elongation or plastic bonding for high strength materials.

REFERENCE SIGNS LIST

1 high-pressure pump body
1*a* pump body
1*c* cylindrical through-hole
1*e* flange
1*f* convex portion
1*g* inclined surface
1*h* plastic bonding portion
1*i* vertical surface

1*j* discontinuous portion
6 cylinder
6*b* large diameter portion
6*c* small diameter portion
6*e* annular protrusion
6*d* cylinder end surface
6*f* cylinder fitting hole
6*g* cylinder shoulder portion
6*h* cylinder fitting hole bottom surface
6*i* tapered surface
6*j* cylinder side surface
7 seal holder
7*a* sub-chamber
8 discharge valve mechanism
9 pressure pulsation reduction mechanism
10 low-pressure fuel chamber
11 pressurizing chamber
12 discharge joint
13 plunger seal
15 retainer
20 fuel tank
21 feed pump
23 common rail
24 injector
26 pressure sensor
27 engine control unit
28 suction pipe
30 suction valve
33 suction valve biasing spring
35 rod
40 rod biasing spring
43 electromagnetic coil
51 suction joint
52 suction filter
61 O-ring
92 tappet
93 cam mechanism
100 relief valve mechanism
200 punch
200*a* punch pressurizing surface
300 electromagnetic suction valve mechanism

The invention claimed is:

1. A high-pressure fuel supply pump, comprising:

a pump body in which a pressurizing chamber is formed, and a cylinder inserted into a hole formed in the pump body and formed in a cylindrical shape, the high-pressure fuel supply pump comprising:

a protrusion disposed at an end portion of the pump body opposite to the pressurizing chamber, formed from an outer peripheral side to an inner peripheral side with respect to an inner peripheral surface opposite to an outer peripheral surface of the cylinder, and protruding toward the cylinder, wherein the protrusion is formed so as to protrude to a side opposite to the pressurizing chamber with respect to a flat portion of the end portion of the pump body, and the protrusion is formed so as to support the cylinder from a side opposite to the pressurizing chamber, wherein pressure is applied to the protrusion of the pump body from the side opposite to the pressurizing chamber such that the protrusion comes into contact with a side surface of an anti-pressurizing chamber of the cylinder.

2. The high-pressure fuel supply pump according to claim 1, wherein an inner peripheral portion of the protrusion is formed so as to be inclined toward the inner peripheral side from the inner peripheral surface opposed to the outer peripheral surface of the cylinder toward the side opposite to the pressurizing chamber.

3. The high-pressure fuel supply pump according to claim 1, wherein an inner peripheral portion of the protrusion is formed so as to be inclined toward the inner peripheral side from the inner peripheral surface opposed to the outer peripheral surface of the cylinder toward the side opposite to the pressurizing chamber, and the cylinder is supported by a side surface of the pressurizing chamber of the inner peripheral portion of the protrusion.

4. The high-pressure fuel supply pump according to claim 1 wherein an outer peripheral portion of the protrusion is formed so as to be inclined toward a side opposite to the pressurizing chamber from the flat portion of the end portion of the pump body to an inner peripheral side.

5. The high-pressure fuel supply pump according to claim 1, wherein the protrusion has a ring shape.

6. The high-pressure fuel supply pump according to claim 1, wherein a convex portion has a ring shape having one or more discontinuous portions.

7. The high-pressure fuel supply pump according to claim 1, wherein a tapered portion is provided at an outer peripheral side end portion of the cylinder and an end portion opposite to the insertion direction so as to be inclined toward the inner peripheral side in a direction opposite to an insertion direction of the cylinder.

8. The high-pressure fuel supply pump according to claim 1, wherein a cylinder fitting hole bottom surface is formed in the pump body, an annular protrusion protruding locally from the cylinder toward the cylinder fitting hole bottom surface is formed on a cylinder end surface, and the annular protrusion bites into the cylinder fitting hole bottom surface, so that sealing is performed.

9. The high-pressure fuel supply pump according to claim 1, wherein an elastic compression strain in a direction of the cylinder axis remains between an outer peripheral side end portion of the cylinder and the cylinder end surface, and the elastic compression strain is held between the bonding fixing portion of the pump body and the cylinder fitting hole bottom surface.

10. A method of manufacturing a high-pressure fuel supply pump, comprising:

fitting a cylinder into a cylinder fitting hole having a cylinder fitting hole bottom surface of a pump body;

compressively deforming a convex portion provided in advance at a peripheral portion of an inlet of the cylinder fitting hole of the pump body in a cylinder insertion direction by a part of an end surface of a punch, such that the convex portion is plastically deformed toward an inner peripheral side; and performing plastic bonding so as to cover a cylinder shoulder portion and a cylinder side surface of the cylinder while being pressure-bonded thereto.

11. The method of manufacturing a high-pressure fuel supply pump according to claim 10, wherein a cylinder end surface coming into contact with the cylinder fitting hole bottom surface of the cylinder is pressure-bonded to the cylinder fitting hole bottom surface by the pressurization, and a local protrusion provided on the cylinder end surface plastically deforms and bites into the cylinder fitting hole bottom surface.

12. A method of bonding two members, wherein a fitting portion is a fitting part having a cylindrical shape which is fitted into a body having a bottomed hole and a fitting portion fitted in the bottomed hole, the method comprising:

fitting the fitting part into the bottomed hole of the body; and pressurizing a convex portion provided in advance at a peripheral portion of an entrance of the bottomed hole of the body in a substantially axial direction of the fitting part to be compressively deformed, wherein materials of the convex portion and the vicinity of the convex portion are plastically deformed in the direction of the fitting part, and is fixed and bonded so as to cover over a shoulder portion of the fitting part and a fitting portion side surface of the fitting part while being pressure-bonded.

13. The method of bonding two members according to claim 12, wherein an outer peripheral side of the convex portion is made to be a surface widening in the pressurizing direction.

14. The method of bonding two members according to claim 12, wherein the convex portion is a pressurizing surface of a punch and pressurizes in a substantially axial direction of the fitting part with a part of a punch end surface away from a side surface of the punch.

* * * * *